US005738542A

United States Patent [19]

Jakobeit et al.

[11] Patent Number: 5,738,542

[45] Date of Patent: Apr. 14, 1998

[54] ELECTRICAL CONNECTOR WITH TWO STEP POSITIVE CONTACT RETENTION

[75] Inventors: Erich Dietmar Jakobeit, Rüsselsheim; Ralf Jaklin, Liederbach, both of Germany

[73] Assignee: The Whitaker Corporation, Wilmington, Del.

[21] Appl. No.: 678,878

[22] Filed: Jul. 12, 1996

[30] Foreign Application Priority Data

Jul. 19, 1995 [GB] United Kingdom ..... 9514797

[51] Int. Cl.[6] ..... H01R 13/422

[52] U.S. Cl. ..... 439/595; 439/744

[58] Field of Search ..... 439/752, 595, 439/744

[56] References Cited

U.S. PATENT DOCUMENTS

| | | | |
|---|---|---|---|
| 4,944,688 | 7/1990 | Lundergan | 439/275 |
| 4,973,268 | 11/1990 | Smith et al. | 439/595 |
| 5,071,369 | 12/1991 | Denlinger et al. | 439/595 |
| 5,085,599 | 2/1992 | Meajima et al. | 439/595 |
| 5,116,236 | 5/1992 | Colleran et al. | 439/271 |
| 5,257,951 | 11/1993 | Maeda | 439/752 |
| 5,591,052 | 1/1997 | Watanabe | 439/752 |

FOREIGN PATENT DOCUMENTS

| | | |
|---|---|---|
| 0 214 794 A1 | 3/1987 | European Pat. Off. . |
| 2 218 272 | 11/1989 | European Pat. Off. . |
| 0 655 799 | 5/1995 | European Pat. Off. . |

*Primary Examiner*—Neil Abrams
*Attorney, Agent, or Firm*—Bradley N. Ditty

[57] ABSTRACT

An electrical connector comprising a housing having at least two contact receiving passageways with contacts therein and a locking member for positively retaining the contacts therein, the locking member having an unlocked position where the contacts may be received in the passageways and a locked position where the contacts are positively retained within the passageways, the electrical connector being characterized in that the locking member has an intermediate position wherein one of the contacts would be positively locked within its respective passageway while the other contact is free to be inserted or removed from its respective passageway.

5 Claims, 4 Drawing Sheets

ELECTRICAL CONNECTOR WITH TWO STEP POSITIVE CONTACT RETENTION

BACKGROUND OF THE INVENTION

1. Field of the Invention

This invention relates to electrical connectors and in particular those electrical connectors incorporating a locking member to assure the contacts are positively retained within the connector housing.

2. Description of the Prior Art

It is well known in the industry to incorporate into electrical connectors a positive contact retention feature such as a secondary locking member or a retention member that provides backup to a retention arm disposed within a cavity of the connector that engages an electrical contact inserted therein. These assurance features assure that the contacts, once properly seated within the connector, are not inadvertently displaced therefrom due to vibration or strain upon the leads that are connected to the contact. It is desirable to incorporate a single member that provides this locking assurance feature to all the contacts received within the connector housing.

A problem with this typical construction is that it is possible that for a given application it may be desirable to insert a selected number of the contacts and lock them in position prior to inserting other contacts. As these other contacts are either inserted later in the assembly process or at an all together separate location. Until this point the only known solution to this problem is to bifurcate the locking assurance feature into corresponding components that are dependant upon the order of assembly. While this works admirably enough, the problem it presents is that multiple locking assurance members are required providing additional pieces that may become lost or misplaced. Therefore, it is an object of this invention to provide an electrical connector having a single contact position assurance member wherein at a given position some of the contacts within the connector are positively retained and other cavities are available for receiving contacts and in a locked position all the contacts within the cavities are positively retained therein.

SUMMARY OF THE INVENTION

The objects are accomplished by providing an electrical connector comprising a housing having at least two contact receiving passageways with contacts therein and a locking member for positively retaining the contacts therein, the locking member having an unlocked position where the contacts may be received in the passageways and a locked position where the contacts are positively retained within the passageways, the electrical connector being characterized in that the locking member has an intermediate position wherein one of the contacts is positively locked in its respective passageway while the other contact would be free to be inserted or removed from its respective passageway.

It is an advantage of this invention that some oft he contacts may be positively retained in place by a locking member while other cavities are free to accept contacts therein. It is another advantage of this invention that the afore going advantage enables partial assembly of the connector prior to fully loading all of the contacts while enabling the advantages of contact retention to be realized. It is yet another advantage that the invention is simple and economical.

DETAILED DESCRIPTION OF THE PREFERRED EMBODIMENT

Figure 1:
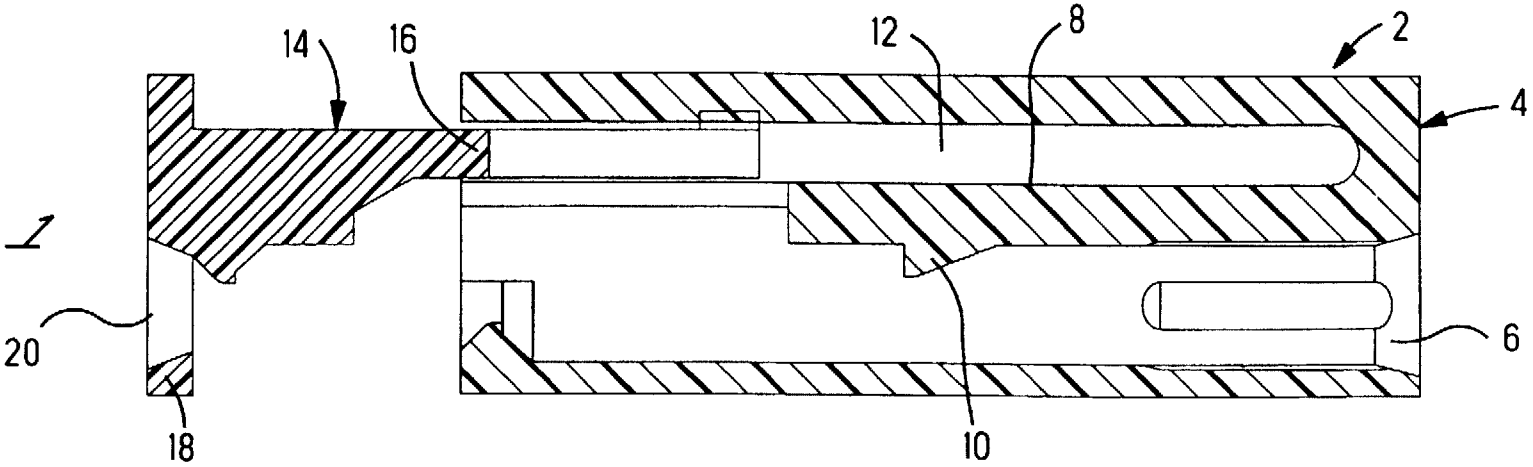
FIG. 1 is a side sectional view of an electrical connector according to the present invention showing the contact locking member in an unlocked position.

With reference now to FIG. 1, an electrical connector according to the present invention is shown in cross-section form generally at 2. The connector 2 includes a housing 4 having a contact receiving passageway 6 extending therethrough where a resiliently deflectable latch arm 8 extends therealong. Resiliently deflectable latch arms 8 are well known in the prior art and contain typically a latch 10 constructed to fit behind the shoulder on the contact for positive retention thereof. As the contact is inserted into the receiving passageway 6 the latch arm deflects Upward into an opening or relieved area 12 thereabove. The connector 2 further includes a locking member 14 including a backup arm 16 that fits within the opening 12 to prevent the latch arm 8 from deflecting in an undesired location, thereby assuring that the latch 10 remains engaged with the contact inserted therein. The locking member 14 includes a front face 18 having a tab receiving passageway 20 therein for receiving a complementary contact into the passageway 6.

Figure 2:
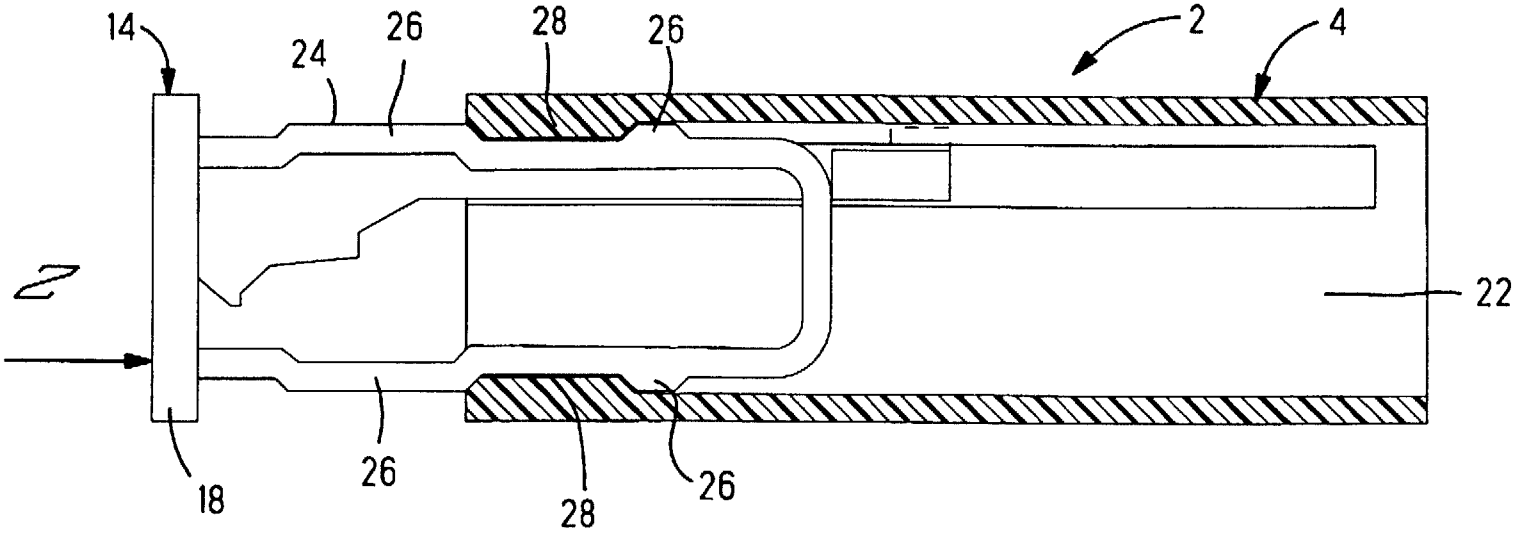
FIG. 2 is a side sectional view of the electrical connector of FIG. 1 showing a latching member therein.

With reference now to FIG. 2, another cross-sectional view of the connector 2 is shown in this position, the housing 4 includes a latch receiving channel 22 wherein a latch 24 of the locking member 14 is received. The latch 24 is a U-shaped element joined to the front plate 18 that has a plurality of latching elements 26 thereupon, these latching elements 26 cooperate with retention members 28 on the housing 4 to positively position the locking member 14 in a first unlocked position. By displacing the locking member 14 in the direction of arrow A the arms of the latch element 24 deflect inward and the locking member is now disposed in the intermediary position.

Figure 3:
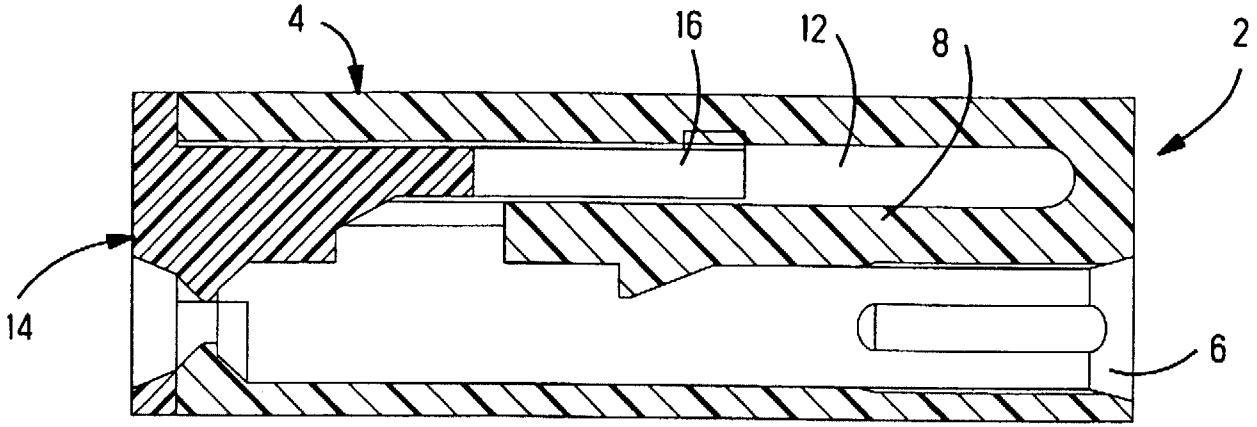
FIG. 3 is a side sectional view of the electrical connector of FIG. 1 showing a first contact receiving passageway.

The intermediary position is shown best in FIG. 3 with respect to a first contact receiving cavity 6. In this position, the backup arm 16 overlies the latch arm 8 and prevents displacement of the latch arm 8 into the opening 12. Furthermore, the locking member 14 has been brought into abutment with the housing 4 such that the passageway 6 is continuous therethrough. With respect to a second contact receiving passageway 6', typically adjacent to the first contact receiving passageway 6 and best seen in FIG. 4, within the housing 4, another latch arm 16' is displaced adjacent to the corresponding latch arm 8'. In this intermediary position, contacts could be received within the passageway 6' as the arm 8' is free to deflect into the opening 12'.

Figure 4:
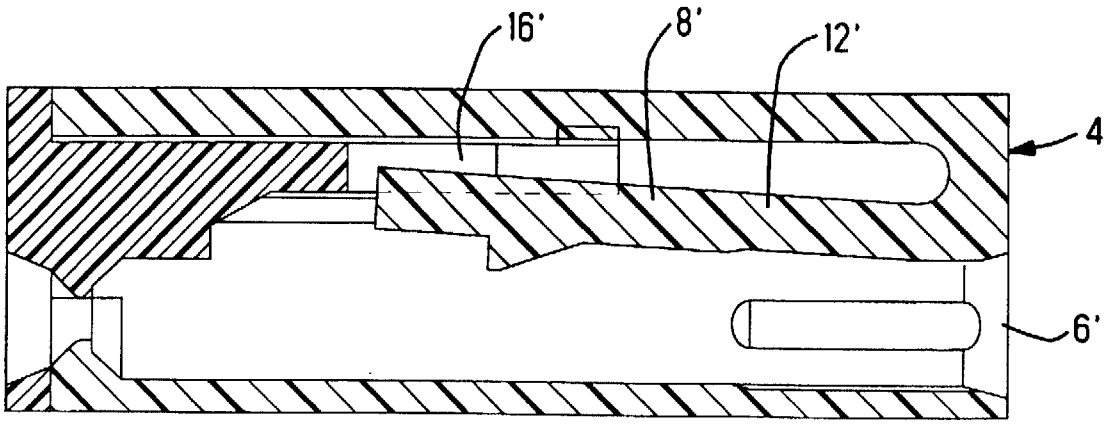
FIG. 4 is a side sectional view of the electrical connector of FIG. 1 showing a second contact receiving passageway.
Figure 5:
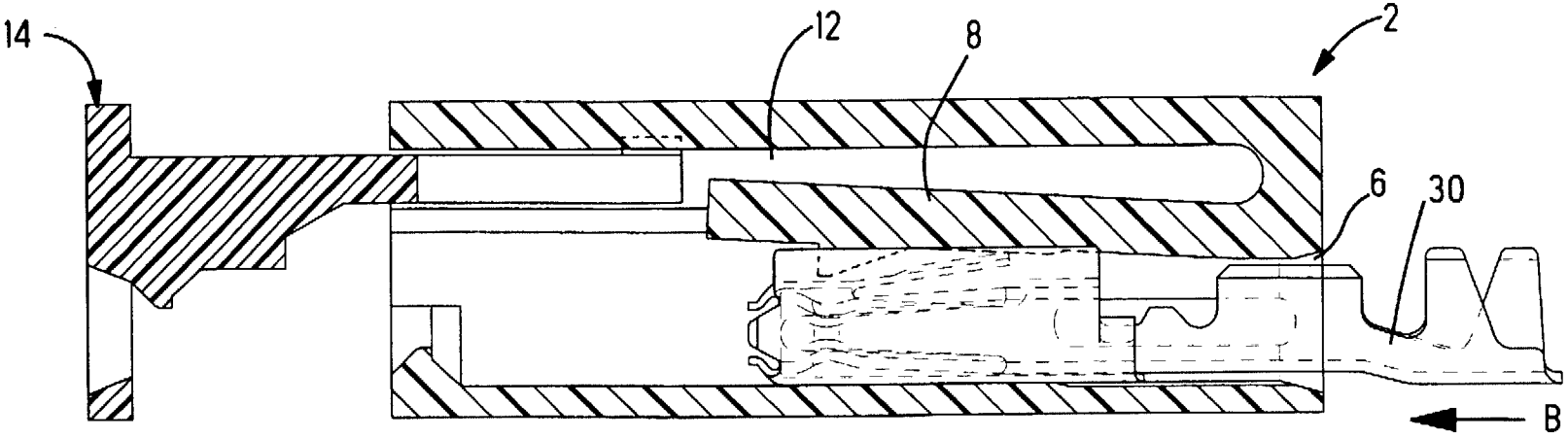
FIG. 5 is a side sectional view of the electrical connector of FIG. 1 showing a contact being inserted therein into the first passageway.
Figure 6:
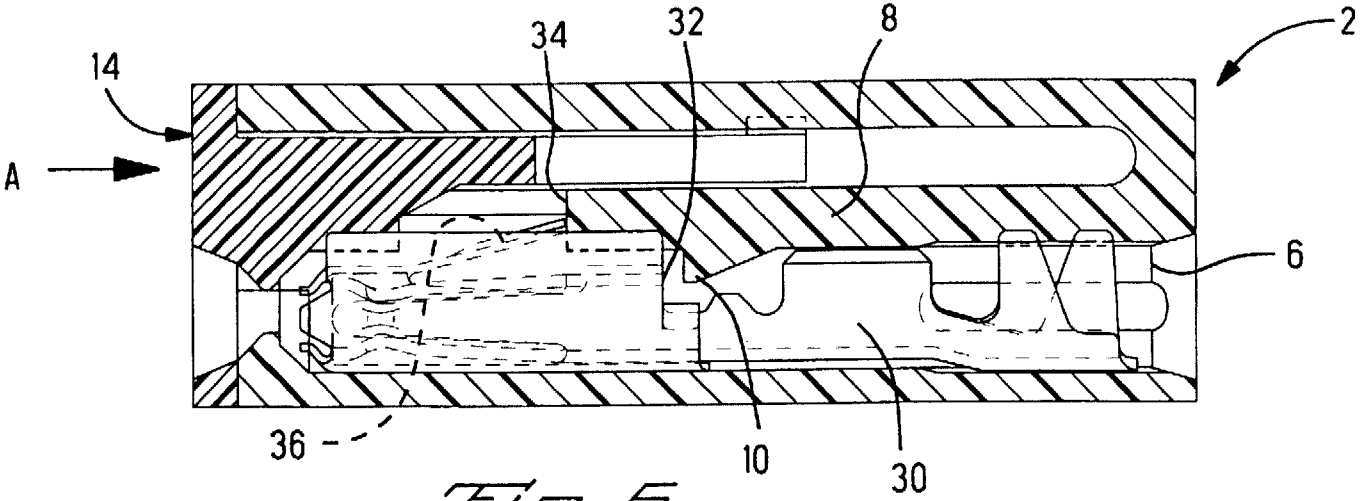
FIG. 6 is a side sectional view of the electrical connector of FIG. 1 showing the contact positively retained therein with the latching member in the intermediate position.

With reference now to FIG. 5 and FIG. 6, the insertion of a contact 30 into the first passageway 6 is illustrated. With the locking member 14 in the unlocked position, the contact 30 may be inserted therein deflecting the latch arm 8 out of the way and into the opening 12 (FIG. 5). With reference now to FIG. 6 when the contact 30 is fully inserted into the passageway 6 the latch arm 8 returns to its original position such that the latch 10 overlies the rear shoulder 32 of the contact 30 and a front shoulder 34 of the latch arm 8 is available for abutment by locking lance 36 of the contact 30. In this position, the locking member 14 is displaced within the direction of arrow A into its preliminary positioned whereby the contacts within passageway 6 are positively retained. With reference to the above description of FIG. 4, it is remembered in this position that the latch arm 8' is still free to displace into the opening 12' corresponding to cavity 6' so that the contact may yet be inserted into the cavity 6'.

Figure 7:
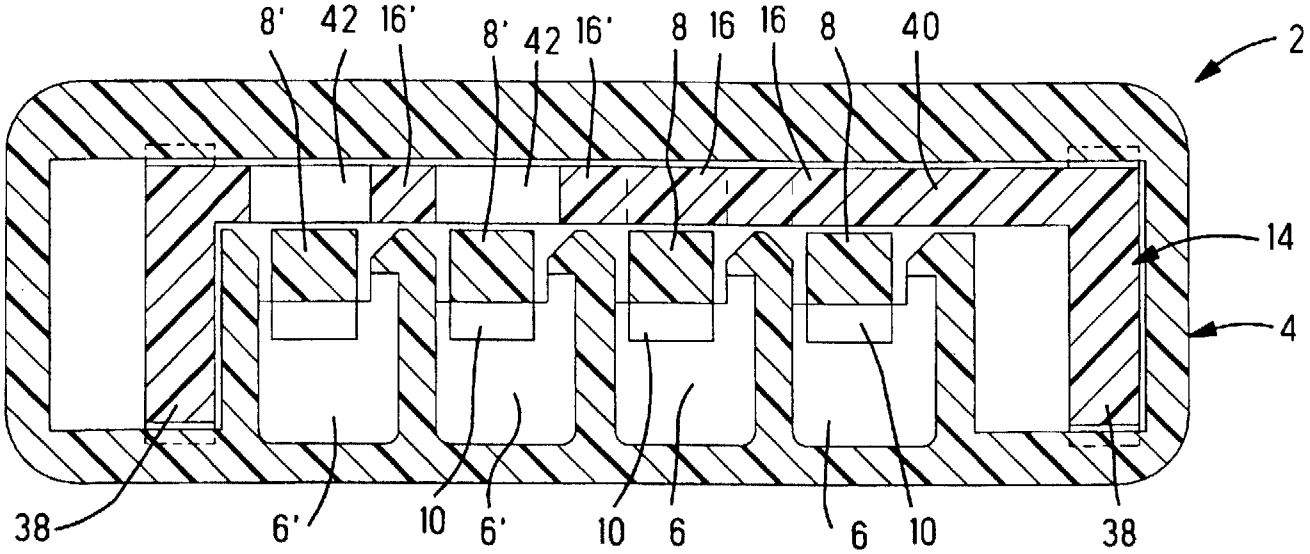
FIG. 7 is a front sectional view of the electrical connector of FIG. 1 showing the locking member in the intermediate position.
Figure 8:
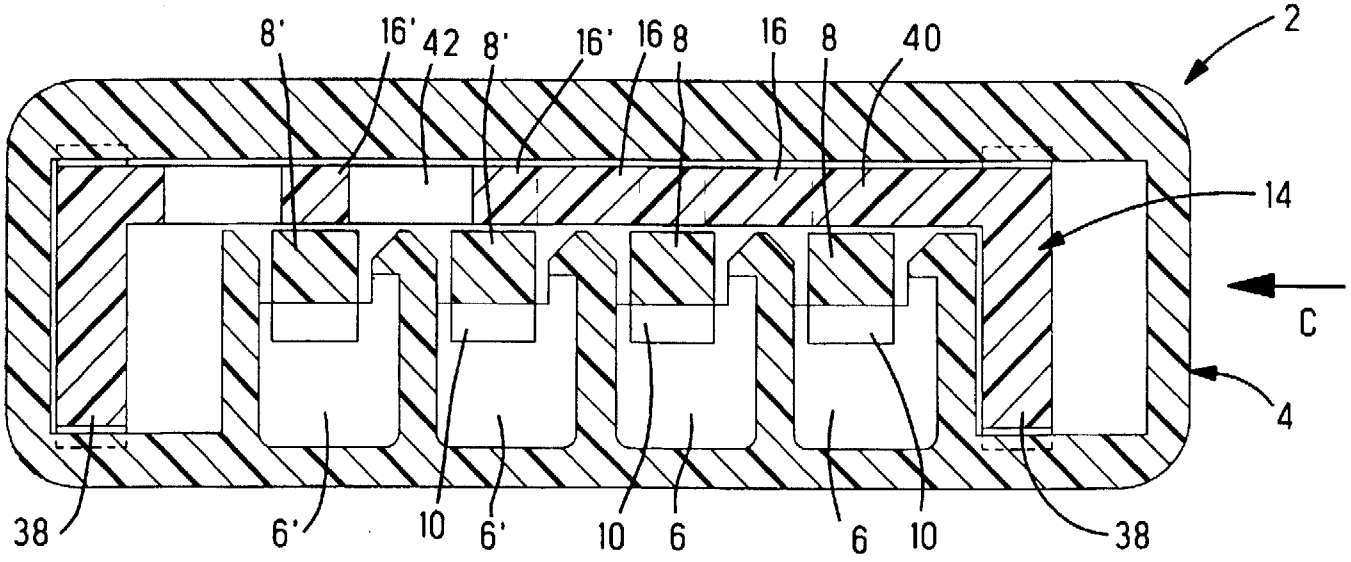
FIG. 8 is a front sectional view corresponding to FIG. 7 showing the locking member in the locked position.

With reference now to FIG. 7, the electrical connector 2 is shown in the preliminary position that corresponds to FIGS. 3,4 and 6. The secondary locking member 14 is received within the housing 4. The secondary locking member 14 is generally U-shaped having opposing leg sections 38 that include the latch member 24. The latches 26 on the latch members 24 ride within grooves in the housing 4 so that the locking member 14 is displaceable transversely. The opposing leg portions 38 are interconnected by a wall 40. The wall 40 includes the backup arm portions 12 that are seen to overlie the locking arms 8 that have the latches 10 depending therefrom. With respect to the second cavity 6', the corresponding backup members 16' are displaced adjacent to the locking arms 8' so that they are free to deflect upward into voids 42 contained within the upper wall 40 as contacts (not shown) are inserted into the second cavity 6'. When the locking member 14 is displaced transversely in the direction of arrow C it is observed that as the upper wall portion 40 is basically continuous where the backup arms 12 are included in the locking arms 8 remain supported and prevented from being deflected upward out of the cavities 6. In this position, the displacement of the locking member 14 has brought the backup arms 16' that correspond to the second cavity 6' over the corresponding retention arms 8' so that a contact received within the second cavity 6' is positively retained therein.

We claim:

1. An electrical connector comprising a housing having at least two contact receiving passageways with contacts therein and a locking member for positively retaining the contacts therein, the locking member having an unlocked position where the contacts may be received in the passageways and a locked position where the contacts are positively retained within the passageways, the locking member has a preliminary position corresponding to the locked position, the locking member is displaceable upon the housing in a longitudinal direction corresponding to the contact receiving passageways to an intermediate position wherein one of the contacts would be positively locked in a first passageway therein while the other contact would be free to be inserted or removed from a second passageway the locking member being further displaceable transversely to the longitudinal direction into the locked position.

2. The electrical connector of claim 1, further characterized in that the housing includes a resiliently deflectable latch arm corresponding to each passageway and a relieved area thereabove, the locking member having back up arms configured to fit into the relieved area in order to prevent deflection of the latch arm, where one of the back up arms is adjacent a wall of the locking member and the other back up arm is adjacent a void in the locking member, where in the intermediate position one of the latch arms overlies one of the latch arms and the void overlies the other of the back up arms.

3. The electrical connector of claim 2, further characterized in that the locking member includes a U-shaped latch having a pair of arms include latching elements receivable in the housing to establish the unlocked, locked and intermediate positions, the arms of the locking member being deflectable for movement between positions.

4. The electrical connector of claim 1, further characterized in that the housing includes a plurality of first contact receiving passageways.

5. The electrical connector of claim 1, further characterized in that the housing includes a plurality of second contact receiving passageways.

* * * * *

UNITED STATES PATENT AND TRADEMARK OFFICE

CERTIFICATE OF CORRECTION

PATENT NO. : 5,738,542
DATED : Apr. 14, 1998
INVENTOR(S) : Erich Dietmar Jakobeit, et al It is certified that error appears in the above-identified patent and that said Letters Patent is hereby corrected as shown below:

Column 4, line 8, "has" should read –having—
line 10, "is" should read –being—
line 25. "where in" should read –wherein—
line 31, after "arms" should read--which--.

Signed and Sealed this

Twenty-third Day of February, 1999

*Attest:*

Q. TODD DICKINSON

*Attesting Officer*

*Acting Commissioner of Patents and Trademarks*